United States Patent [19]

Hanson

[11] Patent Number: 4,546,853

[45] Date of Patent: Oct. 15, 1985

[54] PORTABLE FOLDING PLATFORM APPARATUS USED WITH A LADDER AND WINCH

[76] Inventor: Theodore F. Hanson, 1726 E. Yale, Phoenix, Ariz. 85006

[21] Appl. No.: 627,185

[22] Filed: Jul. 2, 1984

[51] Int. Cl.[4] ..... B66B 9/20; E06C 7/12

[52] U.S. Cl. ..... 182/103; 187/10

[58] Field of Search ..... 182/103, 102, 101; 187/10, 11

[56] References Cited

U.S. PATENT DOCUMENTS

| | | | |
|---|---|---|---|
| 287,042 | 10/1883 | Milliken | 182/103 |
| 715,944 | 12/1902 | Bauer | 182/103 |
| 2,311,070 | 2/1943 | Morando | 182/103 |
| 2,394,148 | 2/1946 | Campbell | 182/103 |
| 3,168,937 | 2/1965 | Redford | 187/10 |
| 3,476,212 | 11/1969 | Eakins | 182/103 |
| 3,666,054 | 5/1972 | Ellings | 182/103 |
| 3,891,062 | 6/1975 | Geneste | 182/103 |
| 4,183,423 | 1/1980 | Lewis | 182/103 |

*Primary Examiner*—Reinaldo Machado
*Attorney, Agent, or Firm*—Weiss & Holloway

[57] ABSTRACT

A portable folding platform apparatus is disclosed which may be removably mounted on an extension ladder having a winch removably mounted at the top of the ladder. The apparatus may be used to lift loads to the top of a house, to the different floors of a building, or onto a roof. The apparatus has a platform with a sliding top which may be used to carry a load. After the apparatus and winch are mounted on the ladder, the winch and cable are then used to pull the apparatus to the top of the ladder. The load may then be moved in a horizontal direction by the sliding top. Two diagonal struts and two vertical struts are used to support the platform. The struts are coupled to two side plates having rollers which allow the apparatus to move up and down the ladder. Guide blocks attached to the side plates assist in guiding the apparatus along the ladder. Two swing arms coupled to the apparatus and the winch have rollers which engage the top surfaces of the ladder. The swing arms rotate as the apparatus moves along the length of the ladder helping to stabilize the apparatus. Quick release connections allow one end of the diagonal struts and one pair of rollers to be uncoupled from the side plates and the apparatus to be quickly removed from the ladder. After the apparatus is removed, it may be folded and easily transported to a job site.

23 Claims, 15 Drawing Figures

PORTABLE FOLDING PLATFORM APPARATUS USED WITH A LADDER AND WINCH

BACKGROUND OF THE INVENTION

The present invention relates generally to hoisting systems and, more particularly, to a portable folding platform apparatus which may be used in conjunction with a ladder and winch.

Extreme difficulty is often encountered in lifting heavy objects to the top of a house, to a second or higher story of a building, or onto a roof. This can be accomplished with a crane, but the expense of using a crane is often prohibitive. For example, it would be too expensive to rent a crane in order to install a typical air conditioning unit on the roof of a private residence. In addition, it would be difficult and expensive to transport a large piece of equipment such as a crane to a job site.

There is a need for an apparatus that can be easily attached to an extension ladder and used to lift loads to the different floors of a building. After the apparatus is removed from the extension ladder, it should be capable of being folded so that it may be transported in the back of a truck.

Accordingly, there is a need for a portable folding apparatus that may be used in conjunction with an extension ladder in order to lift loads to the top of a house, to a second or higher story of a building, or onto a roof. There is a further need for an apparatus that may be easily attached to and removed from the extension ladder. The apparatus should be capable of being folded so that it may be easily transported to a job site. Moreover, the apparatus should also be capable of being used with a winch so that heavy loads may be lifted to the top of the ladder.

SUMMARY OF THE INVENTION

It is an object of this invention to provide an improved, portable folding platform apparatus which may be used with an extension ladder and winch.

It is still another object of this invention to provide an improved, portable folding platform apparatus which may be easily attached to and removed from the extension ladder.

It is still another object of this invention to provide an improved, portable folding platform apparatus which may be folded up and easily transported to a job site.

It is still another object of this invention to provide an improved, portable folding platform apparatus which may be used to lift heavy loads to the top of a house or building or onto a roof.

In accordance with one embodiment of this invention, a portable folding platform apparatus for lifting a load and for use preferably with a ladder and winch is disclosed which comprises platform means for holding the load; strut means operably coupled to the platform means for supporting the platform means; side plate means operably coupled to the strut means for operably guiding and moving the apparatus up and down the ladder; and swing arm means rotatably coupled to the strut means and the side plate means for operably engaging the upper surfaces of the ladder and operably coupling the apparatus to the winch in order to move the apparatus up and down the ladder. In this embodiment, a portable folding platform apparatus and winch are removably mounted on an extension ladder. The apparatus may be used to lift loads to the top of a house, to the different floors of a building, or onto a roof. The apparatus has a platform with a sliding top which may be used to carry a load. After the apparatus and winch are mounted on the ladder, the winch and cable are then used to pull the apparatus to the top of the ladder. The load may then be moved in a horizontal direction by the sliding top. Two diagonal struts and two vertical struts are used to support the platform. The struts are coupled to two side plates having rollers which allow the apparatus to move up and down the ladder. Guide locks attached to the side plates assist in guiding the apparatus along the ladder. Two swing arms coupled to the apparatus and the winch have rollers which engage the top surfaces of the ladder. The swing arms rotate as the apparatus moves along the length of the ladder helping to stabilize the apparatus. Quick release connections allow one end of the diagonal struts and one pair of rollers to be uncoupled from the side plates and the apparatus to be quickly removed from the ladder. After the apparatus is removed, it may be folded and easily transported to a job site.

The foregoing and other objects, features and advantages of this invention will be apparent from the following, more particular, description of the preferred embodiments of the invention, as illustrated in the accompanying drawings.

DESCRIPTION OF THE PREFERRED EMBODIMENT

Figure 1:
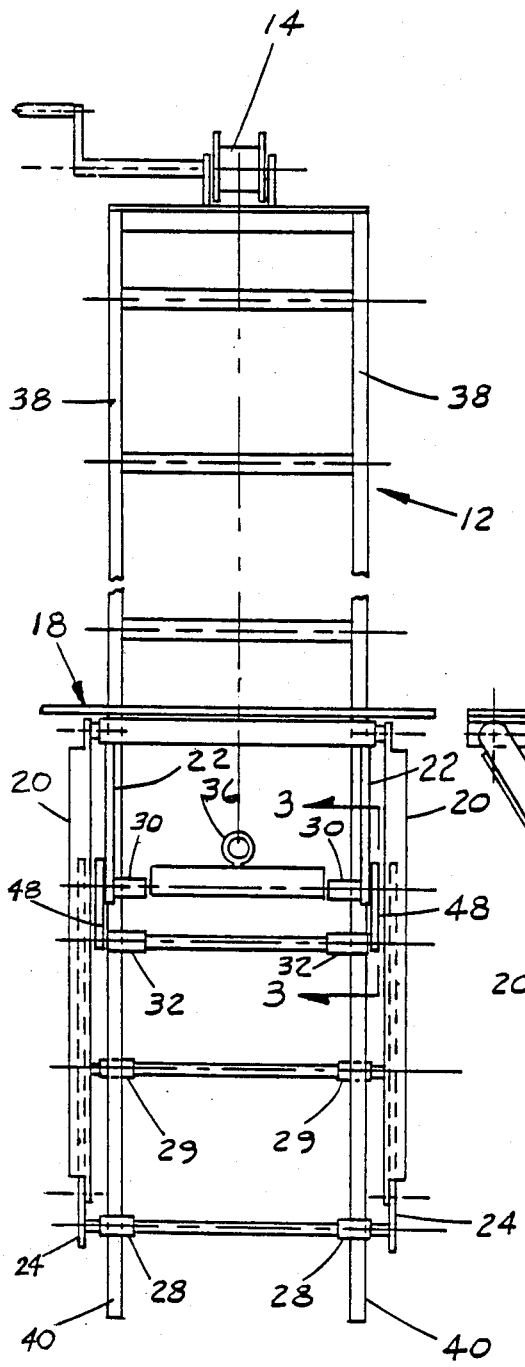
FIG. 1 is a front view of the portable folding platform apparatus mounted on a ladder with a winch at the top of the ladder.
Figure 2:
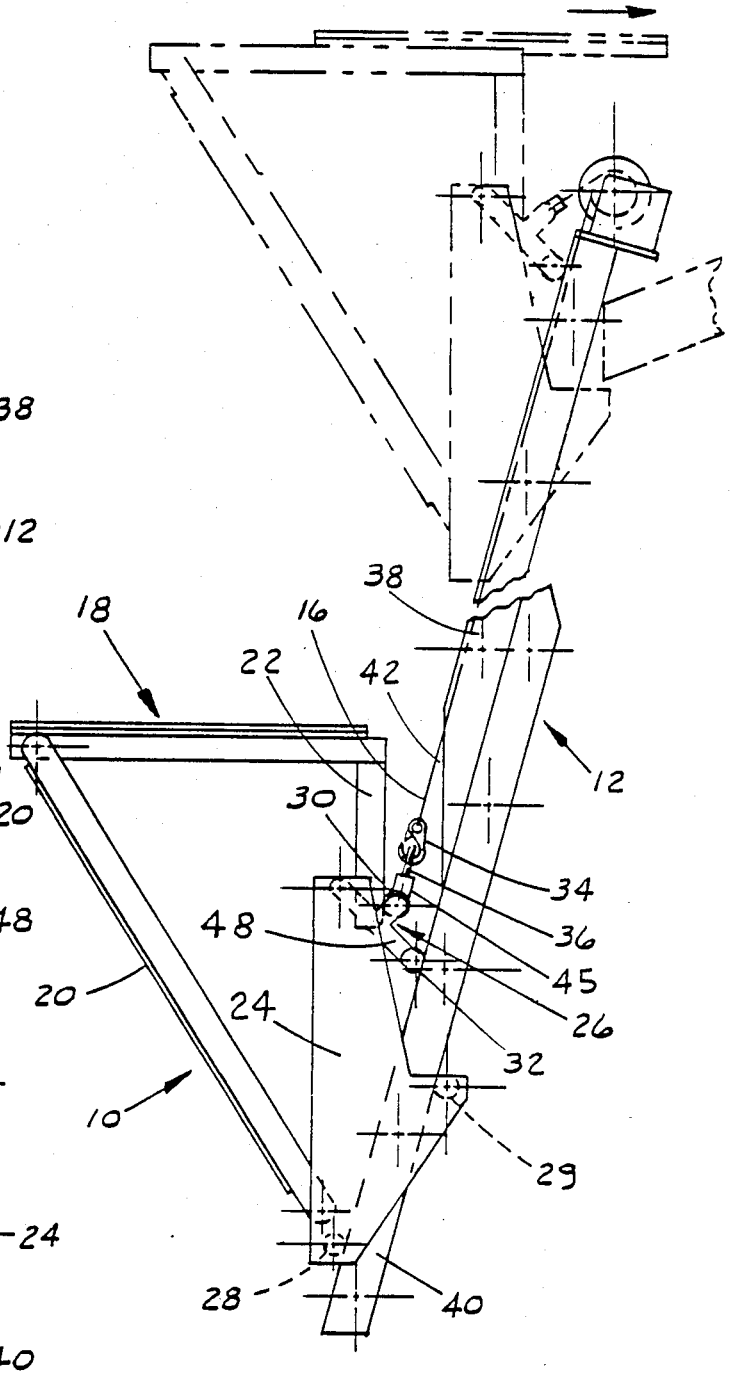
FIG. 2 is a side view of the apparatus and ladder showing how a cable attached to the winch and swing arms is used to move the apparatus (indicated by dashed lines) to the top of the ladder.

FIGS. 1 and 2 show a portable folding platform apparatus, generally designated by reference number 10, operably attached to a ladder 12. The ladder has a winch 14 removably attached to its top end. The winch 14 is connected to the apparatus 10 by a cable 16. Note that a hand winch 14 is shown. However, an electric or gasoline powered winch may be used if desired.

The apparatus 10 may be used as follows. After the apparatus 10 and winch 14 are operably attached to the ladder 12, the winch 14 and cable 16 are used to pull the apparatus to the top of the ladder as illustrated by the dashed lines shown in FIG. 2. Any load carried by the apparatus 10 is then removed in the direction of the arrow shown in FIG. 2.

As shown in FIGS. 1 and 2, the apparatus 10 has a platform 18 supported by two diagonal struts 20 and two vertical struts 22. The diagonal struts 20 are rotatably coupled to the platform 18 and releasably coupled (see FIG. 8) to two side plates 24. The vertical struts 22 are fastened (preferably welded) to the platform 18 and rotatably coupled (see FIGS. 3 and 9) to two swing arms 26. Top rollers 28 and bottom rollers 29 rotatably coupled to the side plates 24 operably engage the top and bottom surfaces of the ladder 12, respectively. The swing arms 26 have middle rollers 30 and arm rollers 32 which operably engage the top surfaces of the ladder 12.

Figure 3:
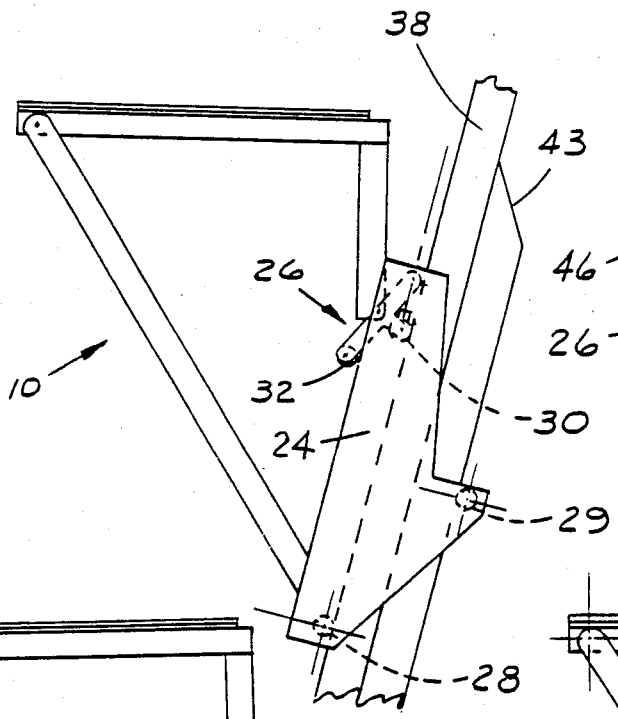
FIG. 3 is an enlarged view of the swing arms taken along line 3—3 in the direction of the arrows shown in FIG. 1.
Figure 3:
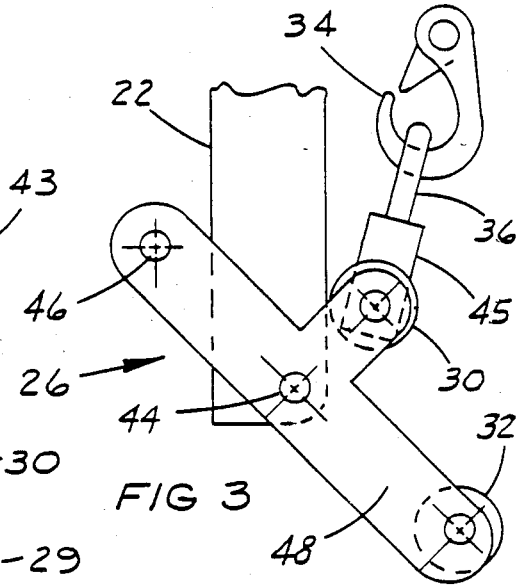

FIGS. 2 and 3 show the cable 16 attached to the swing arms 26 by a hook 34 which is secured to a ring 36 fastened to a beam 45. Note that other ways of attaching the cable 16 to the swing arms 26 may be used if desired. The swing arms 26 preferably have T-shaped swing arm members 48 as shown in FIG. 3. However, other shapes may be used. The T-shaped swing arm members 48 are rotatably coupled to the vertical struts 22 at point 44 and to the side plates 24 (see FIG. 9) at point 46.

Figure 4:
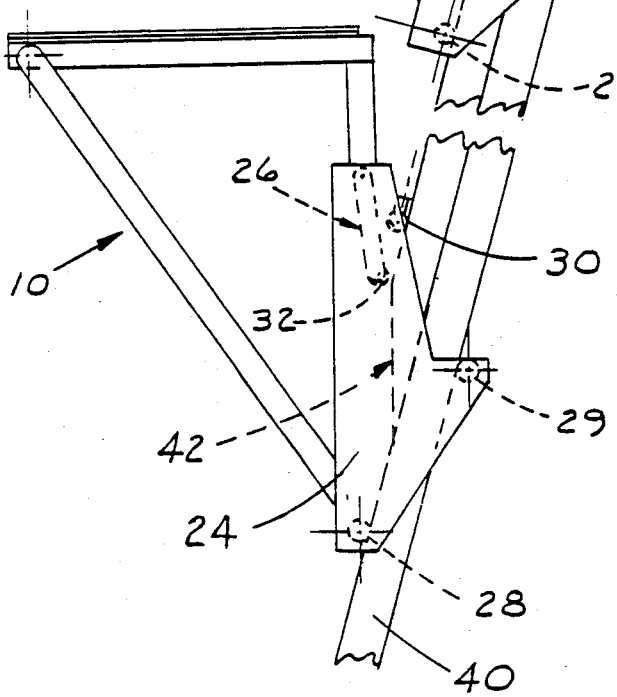
FIG. 4 is a side view of the apparatus and part of the ladder showing how the swing arms travel on top of the ladder.
Figure 5:
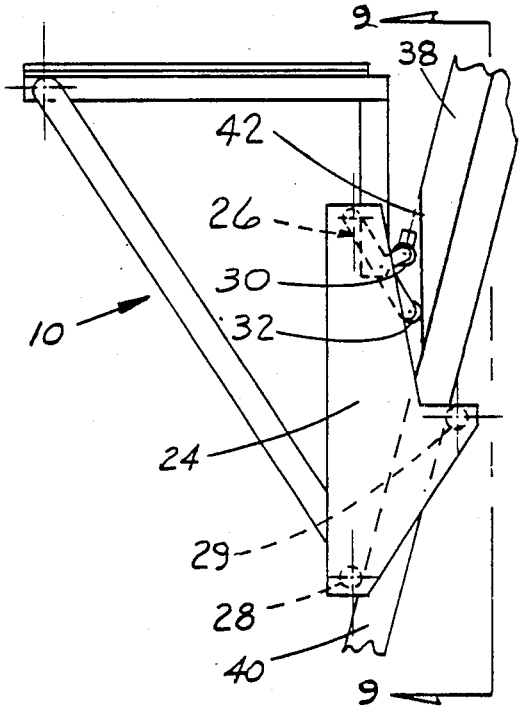
FIG. 5 is a side view of the apparatus and part of the ladder showing how the swing arms travel on the slanted part of the ladder.

FIGS. 2, 4 and 5 show how the rollers 28, 29, 30 and 32 operably engage the top and bottom surfaces of the ladder 12 as the winch 14 winds the cable 16 causing it to pull the apparatus 10 toward the top of the ladder 12. The ladder 12 has an upper portion 38 and a lower portion 40 which slidably engage each other (see FIGS. 6 and 7). The upper portion 38 has slanted surfaces 42 and the lower portion 40 has slanted surfaces 43. FIG. 2 shows the apparatus 10 while it is on the lower portion 40 of the ladder 12. FIG. 5 illustrates how the swing arms 26 move up the slanted surfaces 42 and FIG. 4 shows the orientation of the swing arms 26 after they have engaged the upper portion of the ladder 12. Note how the swing arms 26 rotate to allow the rollers 30 and 32 to engage the top surfaces of the ladder 12 immediately after the swing arms 26 pass over the slanted surfaces 42. As the swing arms 26 pass farther up the ladder 12, they rotate again to allow only the middle rollers 30 to come into contact with the ladder 12. The orientation of the swing arms 26 changes once again as they near the top of the ladder 12 as shown by dashed lines in FIG. 2. As can be seen from the previous discussion, the orientation of the swing arms 26 changes as they travel toward the top of the ladder 12.

Figure 6:
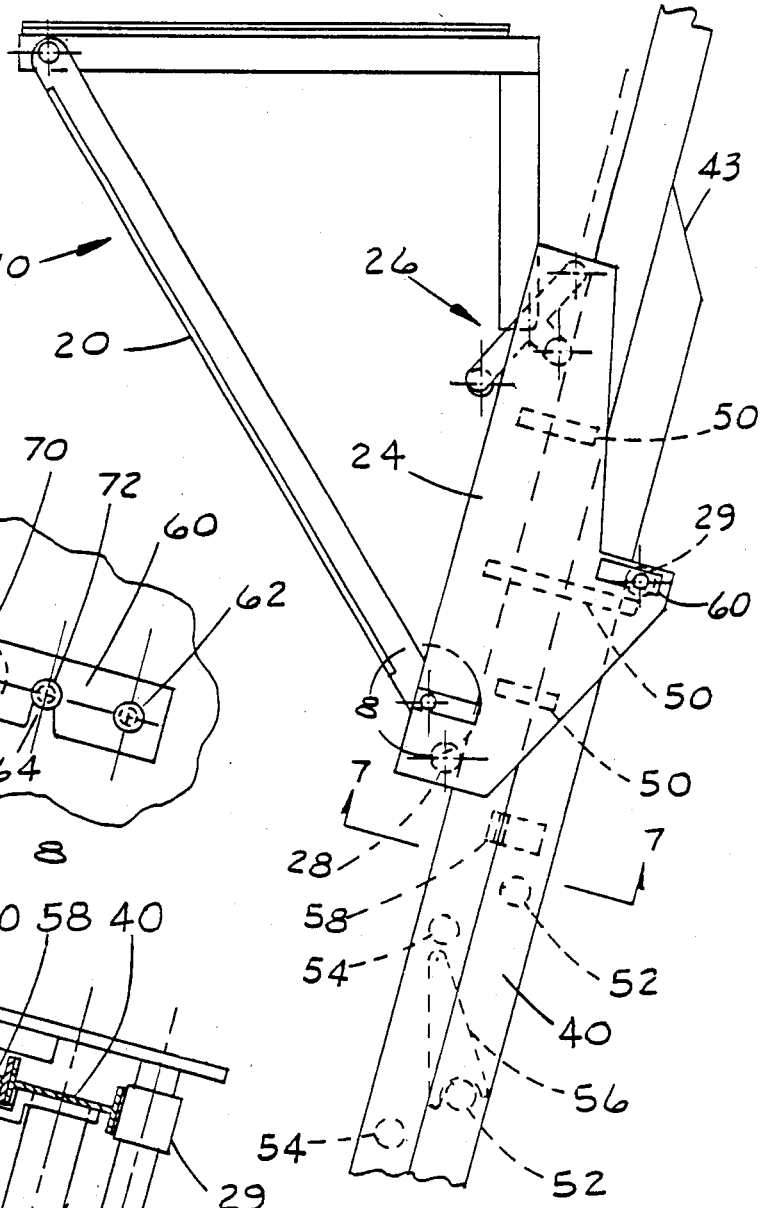
FIG. 6 is an enlarged side view of the apparatus and part of the ladder showing how guide blocks and rollers (indicated by dashed lines) are used to guide two side plates along the length of the ladder.
Figure 7:
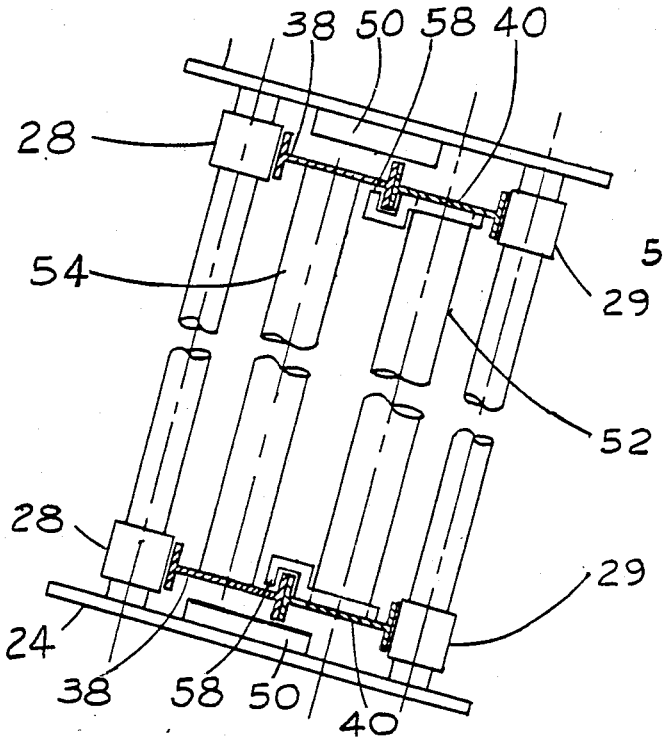
FIG. 7 is an enlarged cross-sectional view of the ladder taken along line 7—7 in the direction of the arrows shown in FIG. 6.

The side plates 24 are guided along the sides of the ladder 24 by guide blocks 50 shown in FIGS. 6 and 7. A crosssectional view of the ladder is shown in FIG. 7. The guide blocks 50 are fastened to the side plates 24 and operably engage the upper and lower portions 38 and 40 of the ladder 12 guiding the top and bottom rollers 28 and 29 so that they keep in contact with the top and bottom surfaces of the ladder 12, repectively. It is important to note that the side plates 24 rotate in order to keep the rollers 28 and 29 in contact with the ladder 12 (see FIGS. 2, 4, 5 and 6) as the apparatus 10 moves along the length of the ladder 12 and over the slanted surfaces 42 and 43.

As shown in FIG. 7, the upper and lower portions 38 and 40 slidably engage brackets 58. As a result, the two portions 38 and 40 of the ladder 12 can be easily slid back and forth in order to increase or decrease the length of the ladder 12. The ladder 12 is locked in place by a spring lock 56 which engages one of the steps 52 of the ladder 12.

Figure 14:
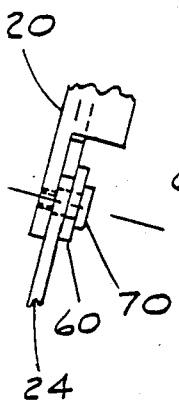
FIG. 14 is a partial end view of the diagonal strut shown connected to one of the side plates in FIG. 8.
Figure 8:
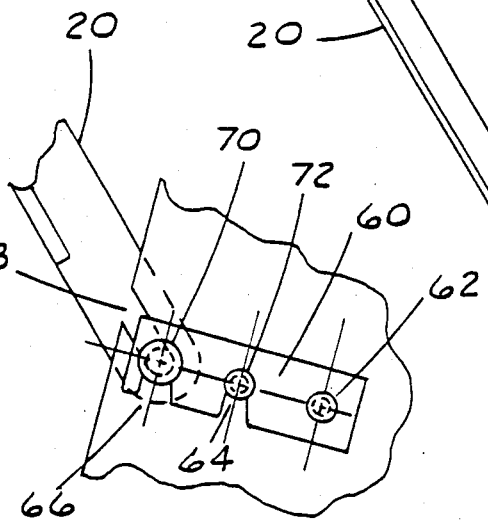
FIG. 8 is an enlarged view of one of two quick release connections (circled in FIG. 6) used to secure the bottom ends of the diagonal struts to the side plates.

Two quick release connections are used to secure the bottom ends of the diagonal struts 20 to the side plates 24. As shown in FIG. 8 (circled in FIG. 6), each of the two quick release connections has a fastening plate 60 rotatably coupled to one of the side plates 24 at point 62. The fastening plate 60 has slots 64 and 66. The side plate 24 has an elongated slot 68 which slidably engages a fastening device 70 attached to the diagonal strut 20. After the fastening device 70 engages the elongated slot 68, the plate 60 is rotated so that the slot 66 engages the device 70 and the slot 64 engages a second fastening device 72 screwed into the side plate 24. The second fastening device 72 is then tightened after the fastening plate 60 is rotated in place. An end view of the quick release connection with the strut 20 locked in place is shown in FIG. 14. In order to release the connection, the second fastening device 72 is loosened. The fastening plate 60 is then rotated so that the slots 64 and 66 no longer engage the fastening devices 72 and 70, respectively. The slot 64 preferably has a circular aperture and counterbore (not shown) for engaging the second fastening device 72. A quick release connection is preferably used to couple the bottom rollers 29 to the side plates 24 (see FIG. 6).

Figure 9:
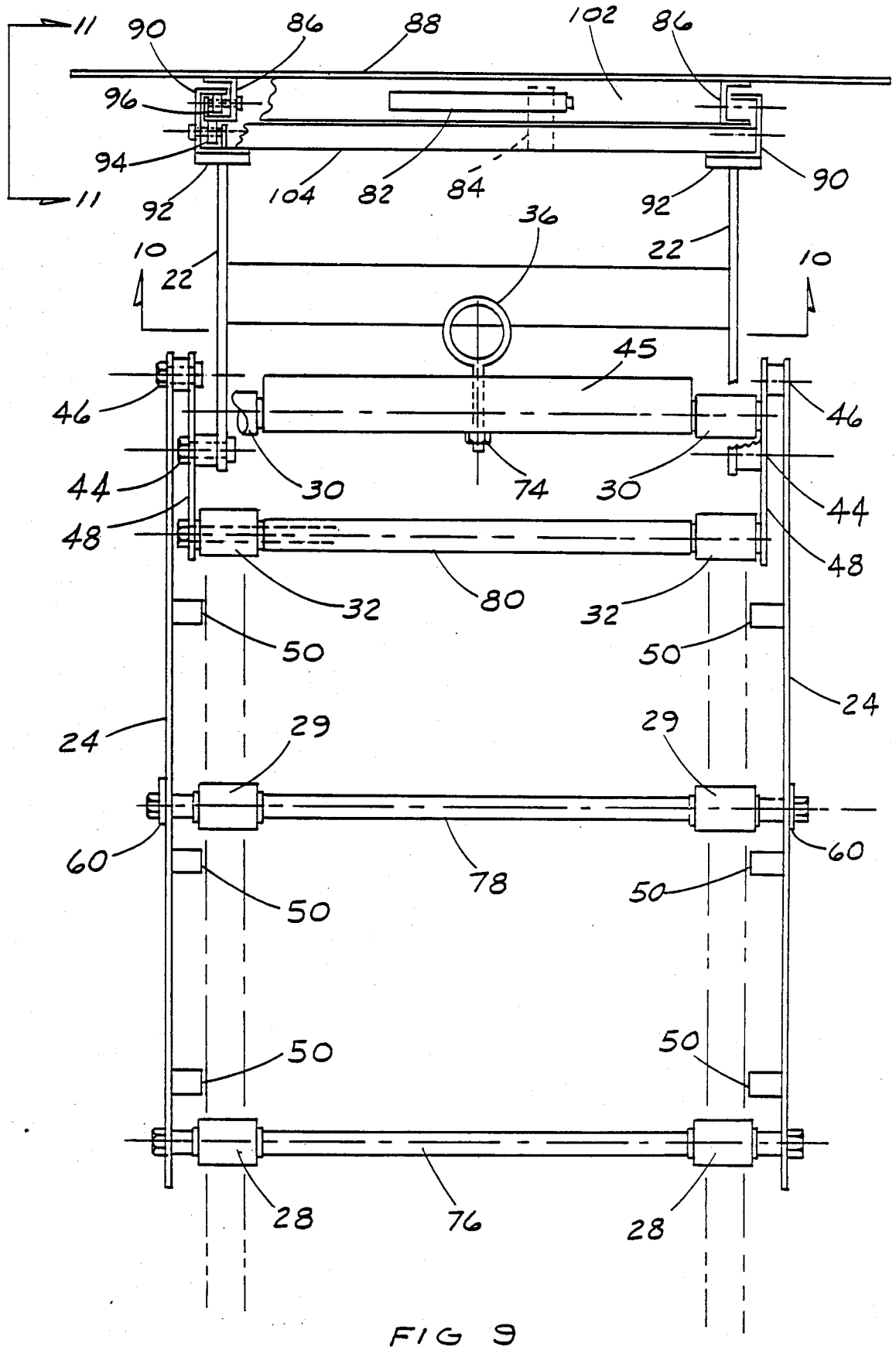
FIG. 9 is an enlarged rear view of the apparatus (taken along line 9—9 in the direction of the arrows shown in FIG. 5) showing the rollers used for the side plate and swing arms and a platform at the top of the apparatus with part of the platform broken away to illustrate how a sliding top is supported by wheels.
Figure 10:
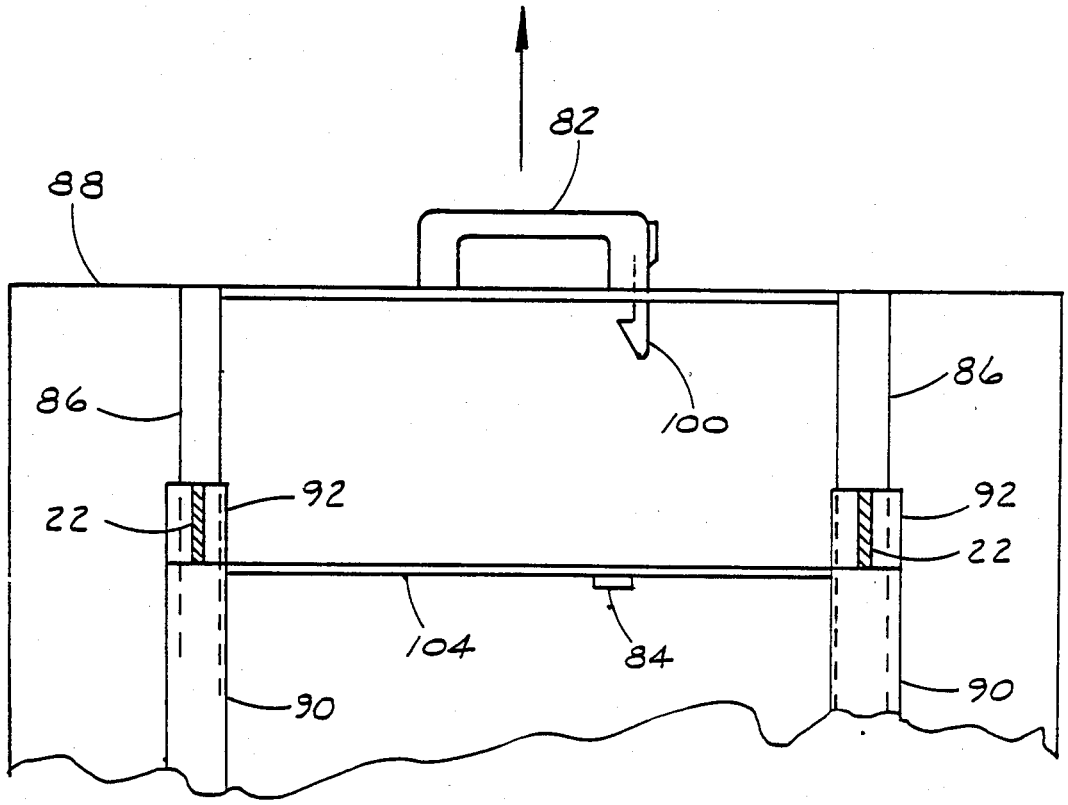
FIG. 10 is a partial bottom plan view (taken along line 10—10 in the direction of the arrows shown in FIG. 9) of the platform showing how a handle may be used to move the sliding top in the direction of the arrow.

FIG. 9 is an enlarged rear view of the apparatus 10. With the exception of a handle 82 and locking plate 84 connected to the platform 18 (see FIGS. 10 and 11), the apparatus 10 is symmetrical about its vertical axis. For that reason, only one side of the apparatus is shown in detail. Note that the top and bottom rollers 28 and 29 coupled to the side plates 24 are separated by elongated rods 78 and 76, respectively. Likewise, an elongated rod 80 and the beam 45 separate the arm rollers 32 and middle rollers 30, respectively. The rollers 28, 29, 30 and 32 are operably coupled to the side plates 24 and swing arms 26 by a plurality of bolts, nuts, washers and bushings. However, any suitable coupling device may be used in place of the bolts, nuts, washers and bushings, if desired. The ring 36 is shown fastened to the beams 45 by a bolt 74. Other ways of fastening the ring 36 may be used.

One end of the platform 18 is shown broken away in FIG. 9 to reveal a lower channel 90 which is attached to an upper plate 92 fastened (preferably welded) to one of the vertical struts 22. An upper channel 86 is supported by a plurality of lower wheels 94 rotatably coupled to lower channel 90. The upper channel 86 has an upper wheel 96 rotatably coupled to it which rolls on the top flange of the lower channel 90 as shown in FIG. 9. The upper channel 86 is fastened to a supporting plate 88 forming a sliding top. Loads carried by the apparatus 10 are placed on top of the supporting plate 88. It is important to note that the other side of the platform 18 is similar to the previously described end having the same wheels 94 and 96 and channels 86 and 90.

Figure 15:
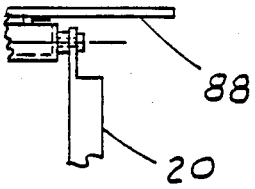
FIG. 15 is a partial front view of one end of the platform showing one of the diagonal struts connected to the platform.
Figure 11:
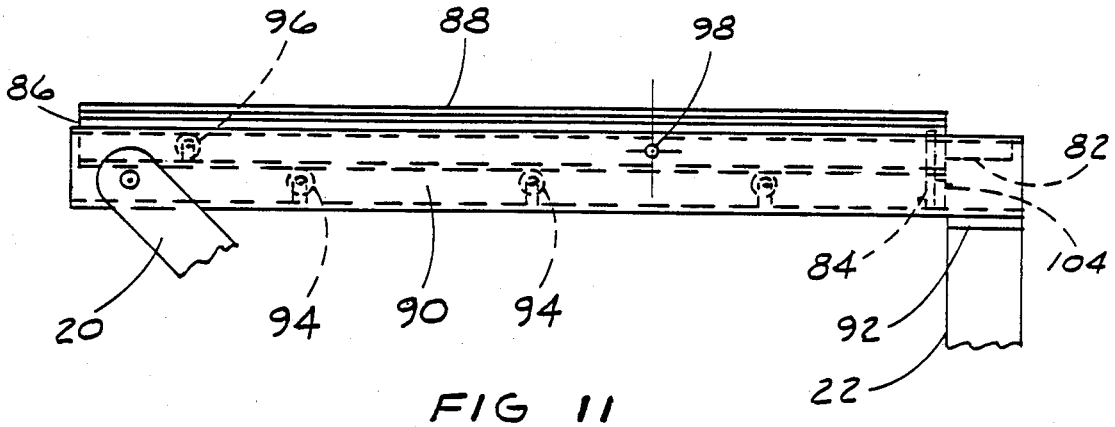
FIG. 11 is a side view (taken along line 11—11 in the direction of the arrows shown in FIG. 9) of the platform showing the wheels (indicated by dashed lines) and a stop pin.

FIGS. 11 and 15 show how the upper ends of the diagonal struts 20 are rotatably coupled to the platform 18. FIG. 11 is a side view of the platform 18 showing how the upper channel 86 rides on the plurality of wheels 94. A handle 82 attached to an upper elongated plate 102 fastened to the upper channels 86 may be grasped to pull the sliding top in the direction of the arrow shown in FIG. 10. Note that a stop pin 98 (see FIG. 11) will come into contact with one of the upper wheels 96 as the sliding top is pulled to the right thereby restricting its movement. The stop pin 98 may be a screw, or the like. Note that separate stop pins 98 may be used at both sides of the platform 18 if desired. The sliding top may be locked in place by a locking device 100 which engages the locking plate 84 attached to a lower elongated plate 104 fastened to the lower channels 90.

Figure 12:
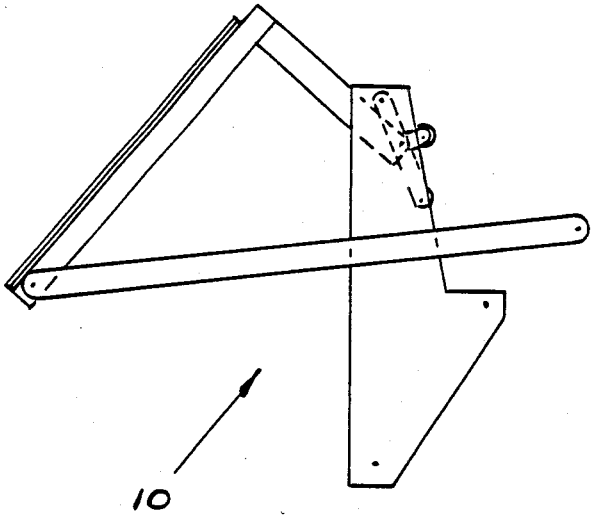
FIG. 12 is a side view showing the apparatus removed from the ladder with the diagonal struts disconnected from the quick release connections and the apparatus in a partially folded position.
Figure 13:
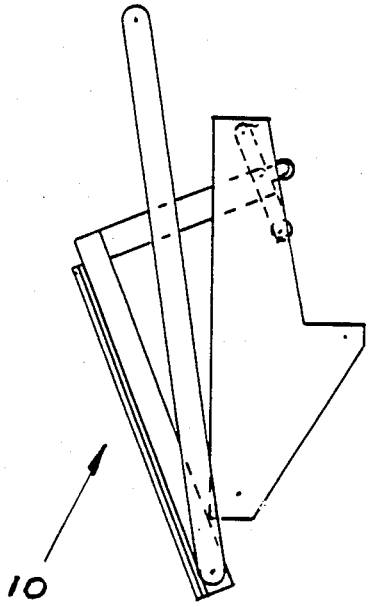
FIG. 13 is a side view showing the apparatus in a fully folded position.

The apparatus 10 may be mounted on the ladder 12 as follows. First, the ladder is placed against a vertical support such as a wall. Then, the winch 14 is attached to the ladder 12 and the cable 16 is extended from the winch 14. The apparatus 10 is attached next by sliding the side plates onto the ladder 12 using the guide blocks 50 and rollers 28, 30 and 32. The rollers 29 are then coupled to the side plates 24 by the quick release connections, securing the apparatus 10 to the ladder 12. After each job is completed, the apparatus 10 may be removed from the ladder 12 and folded as illustrated in FIGS. 12 and 13. The folded apparatus 10 may then be placed in the back of a truck and transported to the next job site.

While the invention has been particularly shown and described in reference to preferred embodiments thereof, it will be understood by those skilled in the art that changes in the form and details may be made therein without departing from the spirit and scope of the invention.

I claim:

1. A portable folding platform apparatus for lifting a load and for use preferably with a ladder and winch, comprising:

platform means for holding said load;

strut means operably coupled to said platform means for supporting said platform means;

side plate means operably coupled to said strut means for operably guiding and moving said apparatus up and down said ladder; and swing arm means rotatably coupled to said strut means and said side plate means for operably engaging the upper surfaces of said ladder and operably coupling said apparatus to said winch in order to move said apparatus up and down said ladder.

2. The apparatus of claim 1, further comprising quick release connection means operably coupled to said side plate means for allowing at least one portion of said strut means to be operably coupled to and released from said side plate means.

3. The apparatus of claim 1, further comprising quick release connection means operably coupled to said side plate means for allowing at least one portion of said strut means to be operably coupled to and released from said side plate means and for allowing said side plate means to be operably coupled to and released from said ladder.

4. A portable folding apparatus for lifting a load, comprising:

an extension ladder;

a winch removably attached to said extension ladder;

side plate means operably engaging said extension ladder for operably guiding and moving said apparatus up and down said extension ladder;

strut means operably coupled to said side plate means for supporting said load;

platform means operably coupled to said strut means for holding said load; and swing arm means operably coupled to said strut means and said side plate means, operably connected to said winch and operably engaging said extension ladder for operably moving said apparatus up and down said extension ladder.

5. The apparatus of claim 4, further comprising quick release connection means operably coupled to said side plate means for allowing at lease one portion of said strut means to be operably coupled to and released from said side plate means.

6. The apparatus of claim 4, further comprising quick release connection means operably coupled to said side plate means for allowing at least one portion of said strut means to be operably coupled to and released from said side plate means and to allow said side plate means to be operably coupled to and released from said ladder.

7. The apparatus of claim 1, wherein said platform means comprises:

a lower channel portion;

a sliding top means slidably engaging said lower channel portion for allowing said load to be moved in a horizontal direction; and locking means attached to said lower channel portion and said sliding top means for locking said sliding top means in place.

8. The apparatus for claim 7, wherein said lower channel portion comprises:

two elongated lower channels;

a plurality of lower wheels rotatably coupled to each of said lower channels; and a lower elongated plate fastened to said lower channels.

9. The apparatus of claim 8, wherein said sliding top means comprises:

two elongated upper channels, each of said upper channels being operably positioned over and inside one of said lower channels and being operably supported by said lower wheels of said one of said lower channels;

an upper wheel rotatably coupled to each of said upper channels, said upper wheel operably engaging one of said lower channels;

at least one stop pin operably coupled to at least one of said upper channels in order to restrict the horizontal movement of said sliding top means; and an upper elongated plate fastened to said upper channels.

10. The apparatus of claim 9, wherein said locking means comprises:

a locking plate attached to said lower elongated plate; and a handle attached to said upper elongated plate, said handle having a locking device which operably engages said locking plate in order to lock said sliding top means in place.

11. The apparatus of claim 1, wherein said strut means comprises:

two diagonal struts rotatably coupled to said platform means and operably coupled to said side plate means; and two vertical struts rotatably coupled to said swing arm means and attached to upper plates which are fastened to said platform means.

12. The apparatus of claim 1, wherein said side plate means comprises:

two side plates;

roller means rotatably coupled to said side plates for rotatably engaging said ladder; and a plurality of guide blocks fastened to each of said side plates in order to slidably guide said side plates up and down said ladder.

13. The apparatus of claim 1, wherein said swing arm means comprises:

two swing arm members;

a first pair of rollers rotatably coupled to said swing arm members; and a second pair of rollers rotatably coupled to said swing arm members, said second pair of rollers having a beam operably positioned between said second pair of rollers and a ring operably coupled to said beam so that said ring may be operably coupled to said winch.

14. The apparatus of claim 2, wherein each of said quick release connection means comprises:

a first fastening device operably coupled to one portion of said side plate means so that said first fastening device may be tightened and loosened;

a second fastening device attached to one portion of said strut means, said second fastening device slidably engaging said one portion of said side plate means; and a fastening plate rotatably coupled to said one portion of said side plate means, said fastening plate having slots which slidably engage said first and second fastening devices so that said first fastening device may be tightened in order to releasably couple said one portion of said strut means to said one portion of said side plate means.

15. The apparatus of claim 3, wherein each of said quick release connection means for allowing at least one portion of said strut means to be operably coupled to and released from said side plate means comprises:

a first fastening device operably coupled to one portion of said side plate means so that said first fastening device may be tightened and loosened;

a second fastening device attached to one portion of said strut means, said second fastening device slidably engaging said one portion of said side plate means; and a fastening plate rotatably coupled to said one portion of said side plate means, said fastening plate having slots which slidably engage said first and second fastening devices so that said first fastening device may be tightened in order to releasably couple said one portion of said strut means to said one portion to said side plate means.

16. The apparatus of claim 3, wherein each of said quick release connection means for allowing said side plate means to be operably coupled to and released from said ladder comprises:

a first fastening device operably coupled to a first portion of said side plate means so that said first fastening device may be tightened and loosened;

a second fastening device attached to a second portion of said side plate means, said second fastening device slidably engaging said first portion of said side plate means; and a fastening plate rotatably coupled to said first portion of said side plate means, said fastening plate having slots which slidably engage said first and second fastening devices so that said first fastening device may be tightened in order to releasably couple said first and second portions of said side plate means to each other.

17. The apparatus of claim 10, wherein said side plate means comprise:

two side plates, said side plates having a plurality of slots;

roller means rotatably coupled to said side plates for rotatably engaging said ladder; and a plurality of guide blocks fastened to each of said side plates in order to slidably guide said side plates up and down said ladder.

18. The apparatus of claim 17, wherein said swing arm means comprises:

two swing arm members;

a first pair of rollers rotatably coupled to said swing arm members; and a second pair of rollers rotatably coupled to said swing arm members, said second pair of rollers having a beam operably positioned between said second pair of rollers and a ring operably coupled to said beam so that said ring may be operably coupled to said winch.

19. The apparatus of claim 18, wherein said strut means comprises:

two diagonal struts, each of said diagonal struts being rotatably coupled to one of said elongated lower channels and operably coupled to one of said side plates; and two vertical struts, each of said vertical struts being rotatably coupled to one of said swing arm members and attached to an upper plate which is fastened to one of said elongated lower channels.

20. The apparatus of claim 19, further comprising quick release connection means operably coupled to said side plates for allowing said diagonal struts to be operably coupled to and released from said side plates, each of said quick release connection means comprising:

a first fastening device operably coupled to one of said side plates so that said first fastening device may be tightened and loosened;

a second fastening device attached to one of said diagonals struts, said second fastening device slidably engaging one of said slots in said one of said side plates; and a fastening plate rotatably coupled to said one of said side plates, said fastening plate having slots which slidably engage said first and second fastening devices so that said first fastening device may be tightened in order to releasably couple said one of said diagonal struts to said one of said side plates.

21. The apparatus of claim 19, further comprising quick release connection means operably coupled to said side plates for allowing said diagonal struts to be operably coupled to and released from said side plates and for allowing said side plate means to be operably coupled to and released from said ladder.

22. The apparatus of claim 21, wherein each of said quick release connection means for allowing said diagonal struts to be operably coupled to and released from said side plates comprises:

a first fastening device operably coupled to one of said side plates so that said first fastening device may be tightened and loosened;

a second fastening device to one of said diagonal struts, said second fastening device slidably engaging one of said slots in said one of said side plates; and a fastening plate rotatably coupled to said one of said side plates, said fastening plate having slots which slidably engage said first and second fastening devices so that said first fastening device may be tightened in order to releasably couple said one of said diagonal struts to said one of said side plates.

23. The apparatus of claim 22, wherein each of said quick release connection means for allowing said side plate means to be operably coupled to and released from said ladder comprises:

a first fastening device operably coupled to one of said side plates so that said first fastening device may be tightened and loosened;

a second fastening device to one of said roller means, said second fastening device slidably engaging one of said slots in said one of said side plates; and a fastening plate rotatably coupled to said one of said side plates, said fastening plate having slots which slidably engage said first and second fastening devices so that said first fastening device may be tightened in order to releasably couple said one of said roller means to said one of said side plates.

* * * * *